US011578418B2

(12) United States Patent
Yoon et al.

(10) Patent No.: US 11,578,418 B2
(45) Date of Patent: Feb. 14, 2023

(54) SILVER ELECTROPLATING COMPOSITIONS AND METHODS FOR ELECTROPLATING SILVER WITH LOW COEFFICIENTS OF FRICTION

(71) Applicant: Rohm and Haas Electronic Materials LLC, Marlborough, MA (US)

(72) Inventors: Youngmin Yoon, Boston, MA (US); Miguel A. Rodriguez, Roxbury, MA (US); Michael Lipschutz, Natick, MA (US); Jamie Y. C. Chen, Worcester, MA (US); Kristen Griffin, Boylston, MA (US)

(73) Assignee: ROHM AND HAAS ELECTRONIC MATERIALS LLC (RHEM), Marlborough, MA (US)

( * ) Notice: Subject to any disclaimer, the term of this patent is extended or adjusted under 35 U.S.C. 154(b) by 0 days.

(21) Appl. No.: 17/592,056

(22) Filed: Feb. 3, 2022

(65) Prior Publication Data

US 2022/0307149 A1 Sep. 29, 2022

Related U.S. Application Data

(60) Provisional application No. 63/167,149, filed on Mar. 29, 2021.

(51) Int. Cl.
*C25D 3/46* (2006.01)

(52) U.S. Cl.
CPC ..... *C25D 3/46* (2013.01)

(58) Field of Classification Search
CPC ..... C25D 3/46
USPC ..... 205/263, 238
See application file for complete search history.

(56) References Cited

U.S. PATENT DOCUMENTS

| | | | | |
|---|---|---|---|---|
| 4,478,691 | A | 10/1984 | Abys | |
| 8,980,077 | B2 | 3/2015 | Romer et al. | |
| 9,512,529 | B2 | 12/2016 | Foyet et al. | |
| 2010/0044239 | A1 * | 2/2010 | Schafer | C25D 3/46 205/238 |

FOREIGN PATENT DOCUMENTS

| | | | | |
|---|---|---|---|---|
| JP | 3012182 B2 * | 2/2000 | ..... | C25D 3/46 |

* cited by examiner

*Primary Examiner* — Edna Wong
(74) *Attorney, Agent, or Firm* — John J. Piskorski

(57) ABSTRACT

Silver electroplating compositions deposit silver with low coefficients of friction on substrates, such as nickel, copper and copper alloys. The silver deposits have coefficients of friction of less than or equal to 1 in contrast to many conventional silver deposits which typically have coefficients of friction greater than 1, such as 1.5. The silver deposits also have improved wear resistance in contrast to silver deposited from many conventional silver electroplating baths. The low coefficients of friction and improved wear resistance of silver deposited from the silver electroplating compositions is especially suitable for connectors and electronics finishes. Preferably, the silver electroplating compositions are cyanide-free silver electroplating compositions.

5 Claims, No Drawings

SILVER ELECTROPLATING COMPOSITIONS AND METHODS FOR ELECTROPLATING SILVER WITH LOW COEFFICIENTS OF FRICTION

FIELD OF THE INVENTION

The present invention is directed to silver electroplating compositions and methods for electroplating silver with low coefficients of friction. More specifically, the present invention is directed to silver electroplating compositions and methods for electroplating silver with low coefficients of friction and improved wear resistance and wherein the silver electroplating compositions are preferably free of cyanide.

BACKGROUND OF THE INVENTION

Silver films are very susceptible to poor wear performance due to low hardness, poor resistance to lateral displacement, and significant degrees of cold welding, a phenomenon in which two silver contacts can bond under usage conditions to hinder removal. For connectors in which repeated mating and un-mating cycles are necessary, poor wear performance is detrimental. Furthermore, as interconnects become denser and finely pitched, the force required to insert and mate electronic components scales with the natively high coefficient of friction (COF~1.5) of silver. This can cause pin failure, especially as pins become smaller and densely spaced. Despite these challenges, silver has the potential to be a very attractive connector finish. Silver natively has one of the lowest contact resistance values among pure metals, and it is significantly cheaper than gold (the leading industry alternative). Thus, to effectively utilize silver, wear and cold-welding resistant silver finishes with low COF is highly desirable.

Therefore, there is a need for a silver electroplating composition which is stable and deposits silver which has a low coefficient of friction and improved wear resistance.

SUMMARY OF THE INVENTION

The present invention is directed to a silver electroplating composition comprising a source of silver ions, a sulfide compound having a formula:

$$HO(CH_2)_2—S—(CH_2)_2OH \quad (I),$$

a sulfonated anionic polymer capable of co-depositing with silver to provide a silver deposit comprising a coefficient of friction of 1 or less without the use of lubricants, salts thereof, or mixtures thereof, and a pH of less than 7.

The present invention is also directed to a method of electroplating a silver on a substrate including:

a) providing the substrate;

b) contacting the substrate with a silver electroplating composition comprising a source of silver ions, a sulfide compound having a formula:

$$HO(CH_2)_2—S—(CH_2)_2OH \quad (I),$$

a sulfonated anionic polymer capable of co-depositing with silver to provide a silver deposit comprising a coefficient of friction of 1 or less without the use of lubricants, salts thereof, or mixtures thereof, and a pH of less than 7; and c) applying an electric current to the silver electroplating composition and the substrate to electroplate a silver deposit on the substrate.

The present invention is further directed to an article comprising a silver layer adjacent a surface of a substrate, wherein the silver layer comprises at least 99% silver by metals basis and has a coefficient of friction of 1 or less without the use of lubricants.

DETAILED DESCRIPTION OF THE INVENTION

As used throughout the specification the abbreviations have the following meanings, unless the context clearly indicates otherwise: ° C.=degrees Centigrade; g=gram; mg=milligram; L=liter; mL=milliliter; mm=millimeters; cm=centimeter; μm=microns; DI=deionized; A=amperes; ASD=amperes/dm$^2$ =plating speed; DC=direct current; N=newtons; COF=coefficient of friction; rpm=revolutions per minute; s=seconds; TDE=2,2'-thiodiethanol; NSFC=naphthalene sulfonic acid formaldehyde condensate; and $M_n$=number average molecular weight.

The term "adjacent" means directly in contact with such that two metal layers have a common interface. The abbreviation "N" means Newtons which is the SI unit of force and it is equal to the force that would give a mass of one kilogram an acceleration of one meter per second per second and is equivalent to 100,000 dynes. The term "coefficient of friction" is a value that shows the relationship between the force of friction between two objects and the normal force between the objects that are involved; and is mathematically expressed by $COF=F_{friction}/F_{vertical}$, wherein $F_{friction}$ is the frictional force, COF is the coefficient of friction and $F_{vertical}$ is the vertical force or normal force, wherein vertical force or normal force is the force applied between two articles which is perpendicular to the direction of relative motion between the two articles while measuring the frictional force between them. The term "metals basis" means that not more than 0.1% of the product is trace metals while the remainder is the product as stated. The term "lubricant" refers to additional compound(s) applied to a surface to lower the COF (an example of a commonly used lubricant is octadecanethiol). The term "tribology" means the science and engineering of interacting surfaces in relative motion and includes the study and application of the principles of lubrication, friction and wear. The term "wear resistance" means the resistance to loss of material from a surface by means of mechanical action. The term "minimal wear" refers to the formation of wear trenches (loss of material) less than 10% of the width of the wear track for lengths of greater than 250 μm. The term "wear trench" is a depression in a silver layer which has a profile depth of greater than ⅓ the local average thickness of the high-durability silver deposit, excluding the contact area where tribometry was directly performed. The term "local average thickness" means the thickness of the silver layer within a 1000 μm radius around the edge of the wear trench. The term "cold welding" means a solid-state welding process in which joining takes place without fusion or heating at the interface of the two parts to be welded and no molten liquid or molten phase is present in the joint. The term "aqueous" means water or water-based. The terms "composition" and "bath" are used interchangeably throughout the specification. The terms "deposit" and "layer" are used interchangeably throughout the specification. The terms "electroplating", "plating" and "depositing" are used interchangeably throughout the specification. The term "matte" means dull or without luster. The terms "a" and "an" can refer to both the singular and the plural throughout the specification. All percent (%) values and ranges indicate weight percent unless otherwise specified. All numerical ranges are inclusive and combinable in any order, except where it is logical that such numerical ranges are constrained to add up to 100%.

The present invention is directed to a silver electroplating composition containing a source of silver ions, a sulfide compound having a formula:

$$HO(CH_2)_2—S—(CH_2)_2OH \quad (I),$$

a sulfonated anionic polymer capable of co-depositing with silver to provide a silver deposit comprising a coefficient of friction of 1 or less without lubricants, salts thereof, or mixtures thereof, and a pH of less than 7. Sulfonated anionic polymers capable of co-depositing with silver to provide a silver deposit comprising a coefficient of friction of 1 or less include, but are not limited to, naphthalene sulfonic acid formaldehyde condensates and poly-acrylic-co-vinylsulfonic acid. Salts include, but are not limited to, sodium salts of naphthalene sulfonic acid formaldehyde condensate and polyacrylic-co-vinylsulfonic acid.

Preferably, the silver electroplating compositions of the present invention include $HO(CH_2)_2—S—(CH_2)_2OH$ (I) or thiodiethanol in combination with one or more of naphthalene sulfonic acid formaldehyde condensates and poly-acrylic-co-vinylsulfonic acid and salts thereof to enable electroplating of a high-durability silver deposit on a substrate with a coefficient of friction (COF) of 1 or less without lubricants. More preferably, the silver electroplating compositions of the present invention include the combination of thiodiethanol and naphthalene sulfonic acid formaldehyde condensate and salts thereof. Preferably, the silver electroplating compositions are cyanide-free.

Sulfides are included in the silver electroplating compositions in amounts of, preferably, 10-300 g/L, more preferably, 20-275 g/L, even more preferably, 35-200 g/L.

Naphthalene sulfonic acid formaldehyde condensate and poly-acrylic-co-vinylsulfonic acid and salts thereof are included in the silver electroplating compositions in amounts of, preferably, 2-100 g/L, more preferably, from 2-35 g/L, even more preferably, from 2-25 g/L.

The aqueous acid silver electroplating compositions of the present invention include a source of silver ions. Sources of silver ions can be provided by silver salts such as, but not limited to, silver halides, silver gluconate, silver citrate, silver lactate, silver nitrate, silver sulfates, silver alkane sulfonates, silver alkanol sulfonates or mixtures thereof. When a silver halide is used, preferably the halide is chloride. Preferably, the silver salts are silver sulfate, a silver alkane sulfonate, silver nitrate, or mixtures thereof, more preferably, the silver salt is silver sulfate, silver methanesulfonate, or mixtures thereof. The silver salts are generally commercially available or can be prepared by methods described in the literature. Preferably, the silver salts are readily water-soluble. Preferably, silver salts are included in the compositions to provide silver ions at a concentration of at least 10 g/L, more preferably, silver salts are included in the compositions in amounts to provide silver ion concentrations in amounts of 10 g/L to 100 g/L, further preferably, silver salts are included in amounts to provide silver ion concentrations of 20 g/L to 80 g/L, even more preferably, silver salts are included in amounts to provide silver ions at concentrations of 20 g/L to 60 g/L, most preferably, silver salts are included in the compositions in amounts to provide silver ion concentrations of 30 g/L to 60 g/L.

Optionally the silver electroplating compositions of the present invention can include an acid. Such acids include, but are not limited to, organic acids such as acetic acid, citric acid, malonic acid, arylsulfonic acids, alkanesulfonic acids, such as methanesulfonic acid, ethanesulfonic acid and propanesulfonic acid, aryl sulfonic acids such as phenylsulfonic acid, tolylsulfonic acid, 5-sulfosalicylic acid and inorganic acids such as sulfuric acid, sulfamic acid, hydrochloric acid, phosphoric acid, hydrobromic acid and fluoroboric acid. Water-soluble salts of the foregoing acids also can be included in the silver electroplating compositions of the present invention. Preferably, the acids are acetic acid, citric acid, 5-sulfosalicylic acid, alkane sulfonic acids, aryl sulfonic acids, sulfamic acid or salts thereof, more preferably, the acids are acetic acid, citric acid, methanesulfonic acid, sulfamic acid or salts thereof. Most preferably, the acid is methanesulfonic acid. Such salts include, but are not limited to, methane sulfonate, sulfamate, citrate, sodium and potassium salts of the acids, such as sodium and potassium acetate, sodium citrate dibasic, sodium citrate monobasic, trisodium citrate, tripotassium citrate, dipotassium citrate, dipotassium citrate dibasic and potassium citrate monobasic. Most preferably, the salt is sodium methane sulfonate or potassium methane sulfonate. Mixtures of acids can be used. The acids are generally commercially available or can be prepared by methods known in the literature. Such acids can be included in amounts to provide a desired conductivity and pH.

Preferably, the acids or salts thereof are included in amounts of at least 5 g/L, more preferably, from 10 g/L to 250 g/L, even more preferably, from 30 g/L to 150 g/L, most preferably from 30 g/l to 125 g/L.

Optionally, inorganic bases such as sodium hydroxide and potassium hydroxide and organic bases such as various types of amines can be used to adjust the pH of the silver electroplating compositions of the present invention. Preferably, the base pH adjusting agents are chosen from potassium hydroxide or sodium hydroxide. The pH adjusting agents can be added in amounts as needed to maintain a desired pH range.

The pH of the silver electroplating composition is less than 7. Preferably, the pH is 0 to 6.5, more preferably, the pH is from 0 to 6, even more preferably, the pH is from 0 to 5, most preferably, the pH is from 0 to 3.

Optionally, the silver electroplating compositions of the present invention include one or more grain refiners. Preferably, the grain refiners are thiol compounds. Such thiol compounds include, but are not limited to, thiol compounds chosen from one or more of thiomalic acid, 2-mercaptosuccinic acid, 3-mercapto-1-propanesulfonic acid, 1-[2-(dimethylamino)ethyl]-1H-tetrazole-5-thiol, and salts thereof. Salts of the thiol compounds include, but are not limited to, alkali metal salts such as sodium, potassium, lithium and cesium; ammonium salts; and tetraalkylammonium salts. Preferably, the thiol compounds are chosen from one or more of 2-mercaptosuccinic acid, 3-mercapto-1-propanesulfonic acid and sodium, 3-mercapto-1-propanesulfonate. More preferably, the thiol compounds are chosen from one or more of 2-mercaptosuccinic acid and sodium, 3-mercapto-1-propanesulfonate, most preferably, the thiol compound is 2-mercaptosuccinic acid.

Preferably, the grain refiners are included in amounts of 5 g/L or greater, more preferably, the thiol compounds are included in amounts of 10 g/L to 100 g/L, further preferably, from 15 g/L to 90 g/L, even more preferably, from 20 g/L to 90 g/L, most preferably, from 30 g/L to 90 g/L.

Optionally, the silver electroplating compositions of the present invention can include one or more brightening agents. Such brightening agents include, but are not limited to, amines such as alkyl, alkylene, alkylol, alkanol or alkylaryl amines and alkylene polyamines and polyalkylene polyimines as disclosed in U.S. Pat. No. 4,246,077, heterocyclic nitrogen compounds, such as 4-amino-1,2,4-triazole, and sulfonate containing brightening agents such as sulfamic acid, 5-sulfosalicylic acid, 3-(1-Pyridinio)-1-propanesulfonate, and naphthalene trisulfonic acid.

Nickel salts can also be included in the aqueous acidic silver electroplating compositions in sufficient amounts to provide a desired bright and uniform silver deposit. Such nickel brightening agents are not substantially incorporated in the silver such that a binary alloy is deposited. Sources of nickel ions include, but are not limited to, nickel sulfate and its hydrated forms nickel sulfate hexahydrate and nickel sulfate heptahydrate, nickel sulfamate and its hydrated form nickel sulfamate tetrahydrate, nickel chloride and its hydrated form nickel chloride hexahydrate, nickel acetate and its hydrated form nickel acetate tetrahydrate, nickel nitrate, nickel nitrate hexahydrate, and mixtures thereof. More preferably, the source of nickel ions is nickel sulfamate and it hydrated form nickel sulfamate tetrahydrate, most preferably, the source of nickel ions is nickel sulfamate. Such nickel salts are commercially available or can be prepared by methods well known in the art.

Preferably, when brightening agents are included in the silver electroplating compositions, they are provided in amounts of 50 mg/L to 20 g/L, more preferably, from 100 mg/L to 10 g/L.

Preferably, in the aqueous acid silver electroplating compositions of the present invention, the water included as a solvent is at least one of deionized and distilled to limit incidental impurities.

Optionally, one or more surfactants can be included in the silver electroplating compositions of the present invention. Such surfactants include, but are not limited to, ionic surfactants such as cationic and anionic surfactants, non-ionic surfactants and amphoteric surfactants. Surfactants can be included in conventional amounts such as 0.05 g/L to 30 g/L.

Examples of anionic surfactants are sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate. Examples of cationic surfactants are quaternary ammonium salts such as perfluorinated quaternary amines.

Other optional additives can include, but are not limited to, levelers and biocides. Such optional additives can be included in conventional amounts.

Preferably, the silver electroplating composition consists of water, one or more sources of silver ions, counter anions, thiodiethanol, a compound selected from the group consisting of naphthalene sulfonic acid formaldehyde condensate, poly-acrylic-co-vinylsulfonic acid, salts thereof and mixtures thereof, optionally an acid, optionally a base, optionally a brightening agent, optionally a grain refiner, optionally a surfactant, optionally a leveler, optionally a biocide and a pH of less than 7.

More preferably, the silver electroplating composition consists of water, one or more sources of silver ions, counter anions, thiodiethanol, naphthalene sulfonic acid formaldehyde condensate or salt thereof, an acid, a grain refiner, optionally a base, optionally a brightener, optionally a surfactant, optionally a leveler, optionally a biocide and a pH of 0-6.

The silver electroplating compositions of the present invention can be used to deposit silver layers on various substrates. Preferably, the substrates on which silver layers are deposited are nickel, copper and copper alloy substrates. Such copper alloy substrates include, but are not limited to, brass and bronze. More preferably, silver is deposited adjacent to nickel where the nickel layer is adjacent to copper or copper alloy. When the substrate contains a nickel layer, a silver strike layer is first deposited adjacent the nickel. The strike layer ranges in thickness from 0.01-1 μm, preferably, from 0.05-0.4 μm. A silver layer from a plating composition of the present invention is then plated adjacent the strike layer. The electroplating composition temperatures during plating can range from room temperature to 70° C., preferably, from 30° C. to 60° C., more preferably, from 40° C. to 60° C. The silver electroplating compositions are preferably under continuous agitation during electroplating.

The silver electroplating method of the present invention includes providing a substrate, providing the silver electroplating composition of the present invention and contacting the substrate with the silver electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating high-durability silver to deposit adjacent a surface of a substrate.

Current densities for electroplating the uniform high-durability silver can range from 0.1 ASD or higher. Preferably, the current densities range from 0.5 ASD to 25 ASD, further preferably, from 1 ASD to 20 ASD.

The silver electroplating compositions of the present invention enable deposition of semi-bright to bright and uniform high-durability silver layers. The silver content of the deposits is greater than or equal to 99% silver by metals basis, excluding unavoidable impurities in the deposits.

The thickness of the silver layers of the present invention can vary depending on the function of the silver layers and the type of substrate on which it is plated. Preferably, the silver layer ranges from 0.1 μm or greater. Further preferably, the silver layers have thickness ranges of 0.1 μm to 100 μm, more preferably, from 0.5 μm to 50 μm, even more preferably, from 1 μm to 10 μm, most preferably, from 2 μm to 6 μm. Thickness can be measured by conventional methods known to those of skill in the art. For example, thickness of the silver layers can be measured using a Bowman Series P X-Ray Fluorimeter (XRF) available from Bowman, Schaumburg, Ill. The XRF can be calibrated using pure silver thickness standards from Bowman.

The high-durability silver deposits have a coefficient of friction (COF) of 1 or less, preferably, a COF of 0.1-1, more preferably, a COF of 0.15-0.5, even more preferably, from 0.2-0.45, most preferably, from 0.25-0.45. The COF can be determined by conventional tribological methods and apparatus known to those of skill in the art. For example, tribological testing can be performed using an Anton Paar TRB3 pin-on-disk tribometer equipped with a linear reciprocating stage (available from Anton Paar GmbH, Graz, Austria) in linear mode configuration. No lubricants or chemical post-treatments need be applied on the electroplated silver deposits. A vertical force of 1-5 N is applied for each tribological measurement, and the coefficient of friction is determined using conventional tribometer software and apparatus. The tribometer software can determine COF (μ) mathematically based on the ratio between the applied vertical or normal force (1-5N) and the measured friction force required to move the load bearing object (cap) at a set speed. The mathematical expression is $COF=F_{fricton}/F_{vertical}$.

The high-durability silver deposits have minimal wear as determined by wear track depth profile measured using laser profilometry to determine the extent of wear. Conventional laser profilometry known to those of skill in the art can be used. For example, profilometry measurements can be done using a Keyence VK-X Laser Scanning Confocal Microscope (available from Keyence Corporation of America, Elmwood Park, N.J.). Wear tracks can be measured using laser profilometry at a magnification of 50 to 100×.

The carbon content of the high-durability silver of the present invention is greater than or equal to 0.1% by mass basis of the silver deposit but not greater than 5% by mass basis, excluding particles with domain sizes above 100 nm in diameter, of the silver deposit. A domain refers to a coherent crystal or grain which are interchangeable terms. Preferably, the carbon content of the high-durability silver of the present invention is 0.5-3.5% carbon by mass, more preferably, 1-3% carbon by mass. No carbon particles, such as graphite or other carbon allotropes and oxidized forms thereof are used in the silver electroplating compositions, eliminating any hazards associated with small particle use. The carbon content in the wear resistant silver deposits can be determined by conventional methods known in the art. Determination of carbon-content may be achieved by burning a sample of plated silver deposit in an oxygen stream at about 1200° C. over platinum wool. The resulting carbon dioxide is determined by infrared spectroscopy according to DIN EN ISO 15350:2010, a conventional process known in the art.

The following examples are included to further illustrate the invention but are not intended to limit its scope.

Silver Electroplating Examples 1-20:

Unless otherwise noted, the electroplating substrates were flat phosphor bronze (alloy C51100) coupons with dimensions of 1.25 cm×2.5 cm or C26000 brass coupons (70% copper, 30% zinc) with dimensions of 2.5 cm×3.5 cm. The substrate choice between C51100 and C2600 did not significantly impact tribological results and were used interchangeably in the following examples. Tribological mobile wear partners were hemispheric phosphor bronze substrates (C51100) of 0.7 cm in diameter, with a flat base of 0.9 cm in diameter. Prior to electroplating, the coupons were electrocleaned in RONACLEAN™ DLF Electrolytic Alkaline Degreaser (available from DuPont de Nemours) at 50° C. for 30 seconds with cathodic DC at a current density of 4 ASD. Stainless steel was used as anodes in this configuration. After electrocleaning, the coupons were rinsed with DI water, activated for 30 seconds in 40 g/L sodium persulfate and 1% sulfuric acid solution, rinsed with DI water, then further activated in 10% sulfuric acid for 20 seconds, rinsed with DI water again, and then placed in the electroplating bath. For plating on the brass substrates, persulfate activation was not performed. Unless otherwise noted, a layer of nickel using NIKAL™ SC Electrolytic Nickel (available from DuPont de Nemours) nickel electroplating bath of at least 2 μm thick was plated before plating silver. Electroplating of nickel was performed in square, glass beakers with DC at a current density of 4 ASD for 4 minutes using nickel anodes. Agitation was provided by a 5 cm long, TEFLON-coated stir-bar at a rotation rate of 400 rpm and solution volumes of about 400 mL. Electroplating was performed at a temperature of 50° C. Following nickel deposition, the substrate was washed with DI water. If a nickel layer was deposited, a silver strike layer was subsequently plated. In the absence of nickel, silver was plated without plating a silver strike layer. The silver strike layer was deposited using a strike bath consisting of 1 g/L silver metal from silver methanesulfonate, 9.3 g/L 2,2'-thiodiethanol, and 18 g/L methanesulfonic acid solution. A DC current density of 2 ASD was applied for 15 seconds in a glass beaker with platinized titanium anodes. Live or hot entry techniques were used in which the substrate was introduced into the bath under polarization with limiting voltages set to about 0.05-01 volts beyond cell potential required to plate the substrate with the desired current density. The bath was agitated with a 5 cm long, TEFLON-coated stir-bar at a rotation rate of 400 rpm. The strike bath was operated from 22-27° C. Following the strike deposition of 0.05-0.4 μm, silver was electrodeposited without a rinse step using live entry techniques as described above. Silver was deposited in glass, square beakers using the same agitation and solution volume conditions as above. The silver bath was operated with 2-4 ASD of DC using silver anodes. Electroplating was performed at temperatures between 40-60° C. Plating time was adjusted to achieve silver deposits of 2-6 μm thick. The coupons were then rinsed with DI water and dried using compressed air after plating. All silver electroplating baths were aqueous based. As such, water was added to each bath to bring it to the desired volume. The pH of the silver electroplating baths was adjusted with potassium hydroxide or methanesulfonic acid.

The thickness of the electroplated silver was measured using a Bowman Series P X-Ray Fluorimeter (XRF) available from Bowman, Schaumburg, Ill. The XRF was calibrated using pure silver thickness standards from Bowman.

Tribological testing was performed using an Anton Paar TRB3 pin-on-disk tribometer equipped with a linear reciprocating stage (available from Anton Paar GmbH, Graz, Austria) in linear mode configuration. No lubricants or chemical post-treatments were applied on the electroplated silver deposits. Flat coupons were used as the static partner for the tribological measurement. The mobile wear partner plated with silver had a hemispheric cap geometry with a spherical diameter of 0.7 cm. All tests were performed "like-on-like", meaning that the flat coupon and the cap were each plated with the same silver metal deposit under equivalent conditions. A vertical force of 1-5 N was applied for each tribological measurement, and the coefficient of friction was recorded. The tribometer software Anton Paar Instrum X Version 8.1.5 was used to determine COF (μ) mathematically based on the ratio between the applied vertical or normal force (1-5N) and the measured friction force required to move the load bearing object (cap) at a set speed. The mathematical expression is $COF=F_{fricton}/F_{vertical}$. The mobile partner was programmed to linearly oscillate over the static flat substrate with an amplitude of 1 cm at a maximum linear speed of 1 cm/s. Linear cycles were repeated between 500 to 10000 times to simulate accelerated contact wear over the electroplated parts.

After tribological measurements, the resulting wear track depth profile was measured using laser profilometry to determine the extent of wear. Profilometry measurements were performed using a Keyence VK-X Laser Scanning Confocal Microscope (available from Keyence Corporation of America, Elmwood Park, N.J.). Wear tracks were measured using laser profilometry at a magnification of 50 to 100×.

Carbon content of some of the examples below was determined using the DIN EN ISO 15350:2000 standard method well known in the art.

Example 1 (Invention)

An aqueous silver electroplating bath of the following composition was prepared and tested under the following tribological conditions:

Silver methanesulfonate to supply 20 g/L silver ions
2,2'-thiodiethanol (TDE): 40 g/L
Naphthalene sulfonic acid formaldehyde condensate (NSFC): 20 g/L
pH adjusted to 1
Tribometry: 1N, 500 cycles After electroplating at 45° C., the electrodeposited coating appeared metallic and semi-bright. The measured coefficient of friction of the silver deposit was approximately 0.45. The silver deposit did not wear through to the substrate on the wear track and was largely flat with respect to the background baseline.

Example 2 (Invention)

An aqueous silver electroplating bath of the following composition was prepared and tested under the following tribological conditions:

Silver methanesulfonate to supply 40 g/L silver ions
2,2'-thiodiethanol: 180 g/L
Naphthalene sulfonic acid formaldehyde condensate: 8 g/L
Methanesulfonic acid: 47.3 g/L
pH about 3
Tribometry: 2N, 10000 cycles After electroplating at 55° C., the electrodeposited coating appeared metallic and semi-bright. The measured coefficient of friction of the silver deposit was approximately 0.45. The silver deposit did not wear through to the substrate on the wear track and was largely flat with respect to the background baseline.

Example 3 (Invention)

An aqueous silver electroplating bath of the following composition was prepared and tested under the following tribological conditions:

Silver methanesulfonate to supply 60 g/L silver ions
2,2'-thiodiethanol: 272 g/L
Naphthalene sulfonic acid formaldehyde condensate: 8 g/L
Methanesulfonic acid: 94.5 g/L
pH about 0
Tribometry: 4N, 500 cycles
Wt % carbon: about 1.5

After electroplating at 55° C., the electrodeposited coating appeared metallic and semi-bright. The measured coefficient of friction of the silver deposit was approximately 0.45. The silver deposit did not wear through to the substrate on the wear track and was largely flat with respect to the background baseline.

Example 4 (Invention)

An aqueous silver electroplating bath of the following composition was prepared and tested under the following tribological conditions:

Silver methanesulfonate to supply 40 g/L silver ions
2,2'-thiodiethanol: 136 g/L
Naphthalene sulfonic acid formaldehyde condensate: 8 g/L
Methanesulfonic acid: 94.5 g/L
pH about 0
Tribometry: 4N, 500 cycles
Wt % carbon: about 1.8

After electroplating at 55° C., the electrodeposited coating appeared metallic and semi-bright. The measured coefficient of friction of the silver deposit was approximately 0.35. The silver deposit did not wear through to the substrate on the wear track and was largely flat with respect to the background baseline.

Example 5 (Invention)

An aqueous silver electroplating bath of the following composition was prepared and tested under the following tribological conditions:

Silver methanesulfonate to supply 40 g/L silver ions
2,2'-thiodiethanol: 272 g/L
Naphthalene sulfonic acid formaldehyde condensate: 8 g/L
Methanesulfonic acid: 94.5 g/L
pH about 0
Tribometry: 4N, 500 cycles After electroplating at 55° C., the electrodeposited coating appeared metallic and semi-bright. The measured coefficient of friction of the silver deposit was approximately 0.25. The silver deposit did not wear through to the substrate on the wear track and was largely flat with respect to the background baseline.

Example 6 (Invention)

An aqueous silver electroplating bath of the following composition was prepared and tested under the following tribological conditions:

Silver methanesulfonate to supply 20 g/L silver ions
2,2'-thiodiethanol: 68 g/L
Naphthalene sulfonic acid formaldehyde condensate: 2.5 g/L
pH adjusted to 2.3
Tribometry: 2N, 1000 cycles
Wt % carbon: about 2.5

After electroplating at 45° C., the electrodeposited coating appeared metallic and bright. The measured coefficient of friction of the silver deposit was approximately 0.4. The silver deposit did not wear through to the substrate on the wear track and was largely flat with respect to the background baseline.

Example 7 (Invention)

An aqueous silver electroplating bath of the following composition was prepared and tested under the following tribological conditions:

Silver methanesulfonate to supply 40 g/L silver ions
2,2'-thiodiethanol: 180 g/L
Naphthalene sulfonic acid formaldehyde condensate: 32 g/L
Methanesulfonic acid: 47.3 g/L
pH about 0.3
Tribometry: 4N, 500 cycles After electroplating at 55° C., the electrodeposited coating appeared metallic and semi-bright. The measured coefficient of friction of the silver deposit was approximately 0.45. The silver deposit did not wear through to the substrate on the wear track and was largely flat with respect to the background baseline.

Example 8 (Invention)

An aqueous silver electroplating bath of the following composition was prepared and tested under the following tribological conditions:

Silver methanesulfonate to supply 20 g/L silver ions
2,2'-thiodiethanol: 68 g/L
Naphthalene sulfonic acid formaldehyde condensate: 2.5 g/L
Sulfamic acid: 5 g/L Potassium methanesulfonate: 30 g/L
pH adjusted to 2
Tribometry: 2N, 1000 cycles After electroplating at 45° C., the electrodeposited coating appeared metallic and bright. The measured coefficient of friction of the silver deposit was approximately 0.3. The silver deposit did not wear through to the substrate on the wear track and was largely flat with respect to the background baseline.

Example 9 (Invention)

An aqueous silver electroplating bath of the following composition was prepared and tested under the following tribological conditions:

Silver methanesulfonate to supply 20 g/L silver ions
2,2'-thiodiethanol: 68 g/L
Naphthalene sulfonic acid formaldehyde condensate: 2.5 g/L
Nickel methanesulfonate to supply 5 g/L nickel ions
Sulfamic acid: 1 g/L
Potassium methanesulfonate: 30 g/L
pH adjusted to 2.5
Tribometry: 2N, 1000 cycles After electroplating at 45° C., the electrodeposited coating appeared metallic and bright. The measured coefficient of friction of the silver deposit was approximately 0.3. The silver deposit did not wear through to the substrate on the wear track and was largely flat with respect to the background baseline.

Example 10 (Invention)

An aqueous silver electroplating bath of the following composition was prepared and tested under the following tribological conditions:

Silver methanesulfonate to supply 20 g/L silver ions
2,2'-thiodiethanol: 50 g/L
Naphthalene sulfonic acid formaldehyde condensate: 20 g/L
5-sulfosalicylic acid: 10 g/L
pH adjusted to 1
Tribometry: 2N, 1000 cycles After electroplating at 40° C., the electrodeposited coating appeared metallic and semi-bright. The measured coefficient of friction of the silver deposit was approximately 0.3. The silver deposit did not wear through to the substrate on the wear track and was slightly elevated with respect to the background baseline.

Example 11 (Invention)

An aqueous silver electroplating bath of the following composition was prepared and tested under the following tribological conditions:

Silver methanesulfonate to supply 20 g/L silver ions
2,2'-thiodiethanol: 68 g/L
Naphthalene sulfonic acid formaldehyde condensate: 2.5 g/L
Nickel methanesulfonate to supply 5 g/L nickel ions
5-sulfosalicylic acid: 1 g/L
pH adjusted to 2
Tribometry: 5N, 10000 cycles After electroplating at 45° C., the electrodeposited coating appeared metallic and bright. The measured coefficient of friction of the silver deposit was approximately 0.35. The silver deposit did not wear through to the substrate on the wear track and was largely flat with respect to the background baseline.

Example 12 (Invention)

An aqueous silver electroplating bath of the following composition was prepared and tested under the following tribological conditions:

Silver methanesulfonate to supply 20 g/L silver ions
2,2'-thiodiethanol: 74 g/L
Poly-acrylic-co-vinylsulfonic acid: 10 g/L
pH adjusted to 2.7
Tribometry: 1N, 500 cycles After electroplating at 55° C., the electrodeposited coating appeared metallic and semi-bright. No nickel layer was plated. The measured coefficient of friction of the silver deposit was approximately 0.5. The silver deposit did not wear through to the substrate on the wear track and was largely flat with respect to the background baseline.

Example 13 (Comparative)

An aqueous silver electroplating bath of the following composition was prepared and tested under the following tribological conditions:

Silver methanesulfonate to supply 20 g/L silver ions
2,2'-thiodiethanol: 113 g/L
Poly-vinylsulfonic acid: 10 g/L
Methanesulfonic acid: 47.3 g/L
pH about 0.3
Tribometry: 1N, 500 cycles After electroplating at 55° C., the electrodeposited coating appeared white matte. No nickel layer was plated. The measured coefficient of friction of the silver deposit was approximately 1.6. The silver deposit showed partial wear of the silver at the wear track, with worn areas showing a depth of 2-4 μm with respect to the background baseline.

Example 14 (Comparative)

An aqueous silver electroplating bath of the following composition was prepared:

Silver methanesulfonate to supply 20 g/L silver ions
2,2'-thiodiethanol: 50 g/L
Naphthalene trisulfonic acid, sodium salt: 10 g/L
pH adjusted to 1.5

After electroplating at 40° C., the electrodeposited coating appeared highly rough, dark brown, and fragile. This deposit was not suitable for wear testing.

Example 15 (Comparative)

An aqueous silver electroplating bath of the following composition was prepared:

Silver methanesulfonate to supply 20 g/L silver ions
2,2'-thiodiethanol: 68 g/L
Poly-styrene sulfonate, sodium salt ($M_{nb\ \sim 70}$ k): 8 g/L
Methanesulfonic acid: 47.5 g/L
pH about 0.3

After electroplating at 55° C., the electrodeposited coating appeared highly rough, grey, and fragile. No nickel layer was plated. This deposit was not suitable for wear testing.

Example 16 (Comparative)

An aqueous silver electroplating bath of the following composition was prepared and tested under the following tribological conditions:

Silver methanesulfonate to supply 20 g/L silver ions
2,2'-thiodiethanol: 27 g/L
5-sulfosalicylic acid: 15 g/L
pH was adjusted to 1
Tribometry: 1N, 500 cycles After electroplating at 40° C., the electrodeposited coating appeared matte brown and white. No nickel layer was plated. The deposit wore through to the substrate within a few cycles, demonstrating poor wear resistance.

Example 17 (Comparative)

An aqueous silver electroplating bath of the following composition was prepared:

Silver methanesulfonate to supply 20 g/L silver ions
2,2'-thiodiethanol: 45 g/L
Ethylenediamine tetrakis(propoxylate-block-ethoxylate) tetrol ($M_n$~3600): 10 g/L
pH was adjusted to 1

After electroplating at 40° C., the electrodeposited coating appeared highly rough, brown, and fragile. No nickel layer was plated. This deposit was not suitable for wear testing.

Example 18 (Comparative)

An aqueous silver electroplating bath of the following composition was prepared:

Silver methanesulfonate to supply 20 g/L silver ions
2,2'-thiodiethanol: 27 g/L
Poly-methacrylic acid: 5 g/L
pH was adjusted to 1

After electroplating at 40° C., the electrodeposited coating appeared highly rough, black, and fragile. No nickel layer was plated. This deposit was not suitable for wear testing.

Example 19 (Comparative)

An aqueous silver electroplating bath of the following composition was prepared:

Silver methanesulfonate to supply 20 g/L silver ions
2,2'-thiodiethanol: 27 g/L
Poly-vinylpyrrolidone: 15 g/L
pH was adjusted to 1.5

The contents of the bath were not fully soluble. After electroplating at 40° C., the electrodeposited coating appeared grey. No nickel layer was plated. This deposit was not suitable for wear testing.

Example 20 (Comparative)

An aqueous silver electroplating bath of the following composition was prepared and tested under the following tribological conditions:

Silver methanesulfonate to supply 20 g/L silver ions
3,6-dithia-1,8-octanediol: 101.4 g/L
Naphthalene sulfonic acid formaldehyde condensate: 10 g/L
pH was adjusted to 2.1
Tribometry: 1N, 500 cycles After electroplating at 50° C., the electrodeposited coating appeared matte grey and white. No nickel layer was plated. The deposit wore through to the substrate within a few cycles, demonstrating poor wear resistance.

Example 21 (Comparative)

Standard Silver Wear Resistance

Standard silver wear performance was benchmarked using deposits produced from an alkaline silver-cyanide bath including 33 g/L silver ions from silver cyanide, 113 g/L potassium cyanide, conventional plating additives for alkaline silver cyanide plating baths with a pH=12. The silver electroplating bath did not include TDE or NSFC. Instead of using a hemispheric cap, the mobile wear partner was a ball made of C26000 brass (70% copper, 30% zinc) which was 5.55 mm in diameter. The ball was electroplated with ~5 μm of silver directly on the substrate after electrolytic cleaning and sulfuric acid activation according to above procedures. The flat coupon was also made of C26000 brass and electroplated with ~5 μm of silver.

Silver was deposited on the substrates in glass, square beakers. The 400 mL baths were agitated with a 5 cm long, TEFLON-coated stir-bar at a rotation rate of 400 rpm. The silver baths were operated with the current densities designated above with cathodic DC using platinized titanium anodes. Electroplating was performed at temperatures of 40° C. Plating time was adjusted to achieve silver deposits of ~5 μm thick. The coupons were then rinsed with DI water and dried using compressed air after plating.

Tribological testing was performed using the same instrumentation and similar procedure as described previously. Again, no lubricants or chemical post-treatments were applied on the silver deposits after plating. Tests were performed using 1 N loading, a stroke length of 1 cm, and a sliding speed of 0.5 cm/s. Tests were performed "like-on-like", meaning that the flat coupon and the spherical ball were each plated with the same silver metal deposit produced from the same electroplating bath. During the test, the coefficient of friction was monitored using the tribometer, and the wear track depth was measured using laser profilometry afterwards. 100 linear cycles at 1 N force were all that was required to break through the silver plated deposit to the substrate, while demonstrating a coefficient of friction of approximately 1.6.

Example 22 (Comparative)

Standard Silver Carbon Content

Substrates were flat stainless-steel coupons with dimensions of 1.25 cm×2.5 cm. Prior to electroplating, the coupons were electrocleaned in RONACLEAN™ DLF Electrolytic Alkaline Degreaser (available from DuPont de Nemours) at 50° C. for 30 seconds with cathodic DC at a current density of 4 ASD. Stainless-steel was used as anodes in this configuration. After electrocleaning, the coupons were rinsed with DI water, activated for 30 seconds in 40 g/L sodium persulfate and 1% sulfuric acid solution, rinsed with DI water, then further activated in 10% sulfuric acid for 20 seconds, rinsed with DI water again, and then silver plated in glass, square beakers containing a conventional alkaline silver-cyanide bath.

The alkaline silver-cyanide bath contained 33 g/L of silver ions from silver cyanide, 113 g/L potassium cyanide, and conventional plating additives for alkaline silver-cyanide plating baths with a pH=12. The silver-cyanide electroplating bath did not include TDE or NSFC.

The baths were agitated with a 5 cm long, TEFLON-coated stir-bar at a rotation rate of 400 rpm. The silver baths were operated at current densities of 2-4 ASD with cathodic DC using silver anodes. Electroplating was performed at temperatures of 40° C. Plating time was adjusted to achieve silver deposits of 2-6 μm thick. The coupons were then rinsed with DI water and dried using compressed air after plating.

The carbon content in the standard silver deposits was determined according to DIN EN ISO 15350:2000. The silver deposits were plated on stainless steel coupons with poor adhesion to the silver layer. The silver deposits were removed from the stainless-steel substrates, weighed, and burned in a chamber using an oxygen stream at about 1200° C. over platinum wool. The resulting carbon dioxide from combustion of organic carbon in the silver deposits was determined by infrared spectroscopy and used to determine the carbon mass in the silver deposits. This value was divided by the total mass of each silver deposit to obtain the carbon weight percentage in each deposit. The resulting carbon dioxide was determined by infrared spectroscopy. The average amount of carbon deposited in the silver deposits was only less than 0.005%.

What is claimed is:

1. A silver electroplating composition consisting of water, a source of silver ions, counter anions, thiodiethanol, a compound selected from the group consisting of naphthalene sulfonic acid formaldehyde condensate, poly-acrylic-co-vinylsulfonic acid, salts thereof, and mixtures thereof, optionally an acid, optionally a base, optionally a brightening agent, optionally a grain refiner, optionally a surfactant selected from the group consisting of anionic surfactant, cationic surfactant, amphoteric surfactant and mixtures thereof, optionally a leveler, optionally a biocide, and a pH of less than 7.

2. The silver electroplating composition of claim 1, wherein the compound is naphthalene sulfonic acid formaldehyde condensate or salt thereof.

3. The silver electroplating composition of claim 1, wherein the acid is an alkane sulfonic acid.

4. The silver electroplating composition of claim 1, wherein the grain refiner is a thiol compound.

5. A method of electroplating silver metal on a substrate comprising:

a) providing the substrate;

b) contacting the substrate with a silver electroplating composition, wherein the silver electroplating composition consists of water, a source of silver ions, counter anions, thiodiethanol, a compound selected from the group consisting of naphthalene sulfonic acid formaldehyde condensate, poly-acrylic-co-vinylsulfonic acid, salts thereof, and mixtures thereof, optionally an acid, optionally a base, optionally a brightening agent, optionally a grain refiner, optionally a surfactant selected from the group consisting of anionic surfactant, cationic surfactant, amphoteric surfactant and mixtures thereof, optionally a leveler, optionally a biocide, and a pH of less than 7; and c) applying an electric current to the silver electroplating composition and substrate to electroplate a silver deposit on the substrate.

* * * * *